United States Patent [19]

Aucouturier et al.

[11] Patent Number: 4,594,530

[45] Date of Patent: Jun. 10, 1986

[54] ACCELERATING SELF-FOCUSING CAVITY FOR CHARGED PARTICLES

[75] Inventors: Jeanne Aucouturier, L'Hay Les Roses; Hubert Leboutet, St. Cloud, both of France

[73] Assignee: CGR MeV, Buc, France

[21] Appl. No.: 610,860

[22] Filed: May 16, 1984

[30] Foreign Application Priority Data

May 20, 1983 [FR] France ..... 83 08427

[51] Int. Cl.[4] ..... H01J 25/10

[52] U.S. Cl. ..... 315/5.41; 315/5.34; 315/5.42; 333/219; 333/227

[58] Field of Search ..... 315/5.41, 5.42, 5.34, 315/5.51, 5.52; 333/218, 227, 249, 219

[56] References Cited

U.S. PATENT DOCUMENTS

| | | | |
|---|---|---|---|
| 2,547,061 | 4/1951 | Touraton et al. | 315/5.41 |
| 3,436,588 | 4/1969 | Hechtel | 315/5.42 X |
| 3,551,728 | 12/1970 | Croitoru | 315/5.41 |

FOREIGN PATENT DOCUMENTS

| | | | |
|---|---|---|---|
| 1068397 | 11/1959 | Fed. Rep. of Germany | 315/5.41 |
| 0658779 | 10/1951 | United Kingdom | 315/5.34 |

*Primary Examiner*—Saxfield Chatmon
*Attorney, Agent, or Firm*—Roland Plottel

[57] ABSTRACT

The invention provides a self-focusing cavity for accelerating charged particles, intended to form the first or only cavity of a linear accelerating structure; this structure accelerating a charged particle beam along an axis merging with a longitudinal axis of this structure. The cavity of the invention comprises an input wall sloping with respect to said longitudinal axis so as to form a surface of revolution providing a charged particle focusing effect.

4 Claims, 2 Drawing Figures

ACCELERATING SELF-FOCUSING CAVITY FOR CHARGED PARTICLES

BACKGROUND OF THE INVENTION

1. Field of the Invention

The present invention relates to an accelerating self-focusing cavity for charged particles, intended more especially to form the first or single accelerating cavity of an accelerating structure of a linear accelerator.

2. Description of the Prior Art

In linear accelerators for charged particles, it is known that an important difficulty is due to defocusing of the charged particle beam along the accelerating structure and more particularly in the first part of the accelerator; this effect asserting itself all the more so since the energy of the particles is still low.

One of the consequences of the defocusing of the beam is that it increases the number of particles situated outside of the acceptance range of the accelerators; this causes degradation of the qualities of the accelerated beam of particles obtained, such for example as the energy homogeneity, and may also affect the over-all efficiency of the accelerator.

Thus, correction of this defocusing effect is particularly advantageous in the first or possibly only accelerating cavity of the accelerating structure. This effect may be corrected by adding solenoids, disposed concentrically about the accelerating structure, so as to create a corrective magnetic field.

Despite its cost, this solution may be comtemplated if the structure has a small section, the electro-magnetic wave injected into this structure for accelerating the beam having a high frequency (generally 3000 MHz); the wave length is then small and the resonance frequency of the accelerating cavities is obtained with small geometrical dimensions of these latter.

This solution is all the more expensive and difficult to apply when the section of the accelerating structure increases and becomes practically impossible to apply when the linear accelerator operates with metric waves; the diameter of the accelerating structure then being between one and two meters.

SUMMARY OF THE INVENTION

The aim of the present invention is to correct the defocusing of a charged particle beam by a new arrangement of an accelerating cavity; this arrangement being, on the one hand, inexpensive in comparison with the solenoid solution and, on the other hand, applicable to all the above mentioned cases.

According to the invention, in an accelerating self-focusing cavity for charged particles, intended to form the first or only cavity of a linear accelerating structure, comprising a longitudinal axis about which it is defined by a peripheral wall having a length parallel to said longitudinal axis and connecting an input wall to an output wall which define said accelerating cavity along said longitudinal axis, said longitudinal axis merging with the axis of a charged particle beam accelerated under the effect of an electro-magnetic wave and penetrating into said accelerating cavity through an input orifice with which said input wall is provided, said output wall being substantially perpendicular to said longitudinal axis and comprising an output orifice through which said beam leaves said accelerating cavity, at least one central zone of the input wall is slanting with respect to said longitudinal axis moving away therefrom in the direction of propagation of said beam so as to form a surface of revolution admitting said longitudinal axis as axis of revolution and to form by means of this surface of revolution a lens for focusing the charged particles.

We ascribe the effect of focusing charged particles in an accelerating cavity in accordance with the invention to a distribution of the electric field components different from that existing in an accelerating cavity of the prior art. Accelerating cavities for a linear charged particle accelerating structure are formed by resonating cavities which, in the prior art, have an input wall normal to the axis of the particle beam; these resonating cavities are excited in a mode such that the maximum electric field component is on the axis of the beam, field lines in the vicinity of the axis of the beam then being parallel to this axis.

We think that, in the accelerating cavity of the invention, the slope of the input wall with respect to the axis of the beam, symmetrically with respect to this latter, gives rise to a radial component in the electric field, while keeping the maximum electric field component on the axis of the beam; the effect of this radial component tending to cause the field lines in the vicinity of the axis to converge towards this axis, causing an effect of focusing of the charged particles.

BRIEF DESCRIPTION OF THE DRAWINGS

The invention will be better understood from the following description and the accompanying Figures in which.

DETAILED DESCRIPTION OF THE INVENTION

Figure 1:
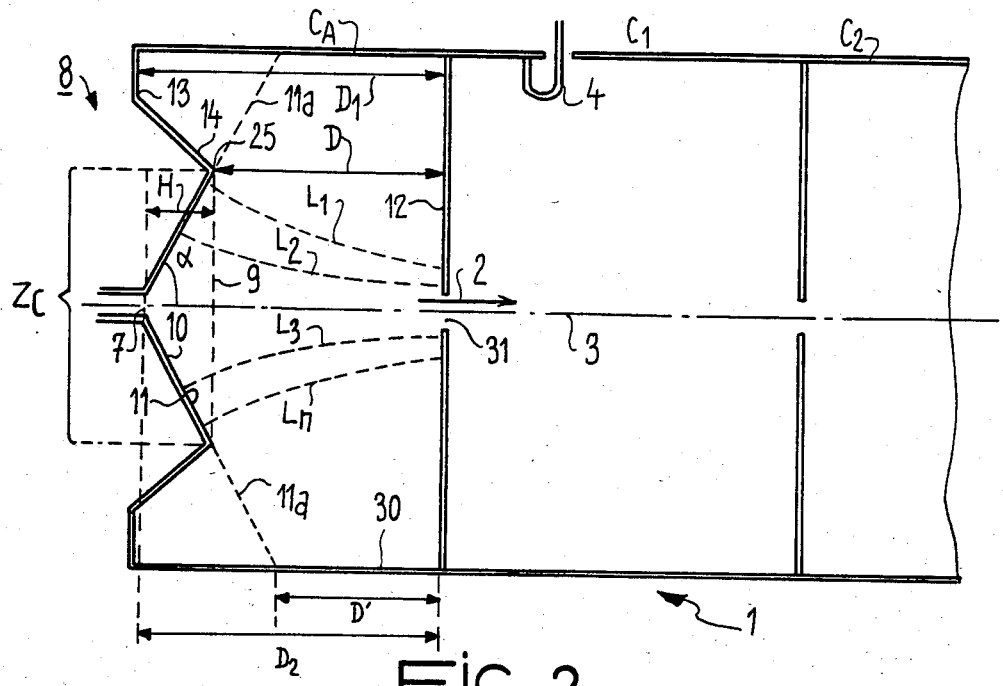
FIG. 1 shows schematically in a longitudinal sectional view an accelerating structure provided with an accelerating self focusing cavity in accordance with the invention.

FIG. 1 shows partially a linear charged particle accelerating structure 1 comprising a first cavity formed from an accelerating cavity CA in accordance with the invention, followed by n accelerating cavities C1, C2, n being in the example equal to 2.

Structure 1 has a longitudinal axis 3 merging with the axis of symmetry of the first cavity CA and which also forms the axis of a particle beam (not shown) propagating in the direction of arrow 2; this particle beam is accelerated by the energy of an electromagnetic wave (not shown) injected in a conventional way into structure 1 through a coupling means 4. In the non limiting example described, the electromagnetic wave is injected into an accelerating cavity C1 which follows the first accelerating cavity CA; this wave may also be injected at another level, and especially at that of the first cavity CA, when this latter forms, in a way known per se, the only accelerating cavity of the structure (not shown).

Means for coupling between cavities CA, C1, C2 as well as other details of the accelerating structure 1 are not shown, since this structure is of a conventional type apart from the shape of an input wall 8 of the first accelerating cavity CA of the invention.

In the non limiting example described, the accelerating cavity CA comprises a circular section defined by a peripheral wall 30 parallel to the longitudinal axis 3 and connecting the input wall 8 to an output wall 12; since the section of the accelerating cavity CA is in a plane perpendicular to that of FIG. 1, it is not visible in this latter.

The particle beam coming for example, in a way known per se, from a electron gun followed by a sliding element (not shown) penetrates into the first accelerating cavity CA through an input orifice 7; this input orifice 7 is centered on the longitudinal axis 3 or axis 3 of the beam and opens into the input wall 8 of the first accelerating cavity CA, the beam leaving this accelerating cavity CA through an output orifice 31 formed in the output wall 12.

In the non limiting example of the description, the input wall 8 comprises a central zone ZC which, from the input orifice 7, is slanted with respect to axis 3 of the beam and moves away therefrom in the direction 2 of propagation of this latter, so as to form a surface of revolution 10 admitting axis 3 of the beam as axis of revolution; this surface of revolution 10, conical in shape in the non limiting example described, being also defined on the one hand by a generatrix formed of a straight line 11 merging in the plane of the Figure with the surface of revolution 10 and, on the other hand, by a directrix formed of a circle 9 which, in the plane of the Figure, forms a straight line shown with broken lines.

The surface of revolution 10 is connected to a peripheral surface 13 of the input wall 8 by an intermediate surface 14; this form of the input wall 8, shown by way of non limiting example, being designed to provide the desired resonance frequency of the cavity CA of the invention.

Tests have shown that it is sufficient for the angle $\alpha$, formed between the generatrix 11 and the axis 3 of the beam, to be slightly less than 90° so as to obtain a focusing effect on the charged particles. This effect being comparable to the one obtained for example by an electrostatic lens (not shown).

As was explained above, this focusing effect is attributed to the existence in the accelerating cavity CA of the invention of a radioelectric field component caused in the non limiting example described by a central zone ZC of the input wall 8 sloping with respect to the axis of the beam 3; field lines L1, L2, L3 . . . Ln between the central zone ZC and the output wall 12 tend then to converge from this central zone towards the axis 3 of the beam and tend to become parallel to this latter, the output wall 12 being substantially perpendicular to this axis 3 of the beam.

An optimum value of angle $\alpha$ depends on the desired amplitude of this focusing effect and determination thereof takes into account more particularly the divergence and the energy of the particle beam penetrating into the accelerating cavity CA of the invention.

It should be noted that a compromise should be sought between the value of angle $\alpha$ and a height H of the cone which the surface of revolution 10 forms, this height H being aligned with a longitudinal axis 3 or axis 3 of the beam. This compromise should be provided more particularly as a function of a minimum distance D to be kept between the output wall 12 and the surface of revolution 10 with which the input wall 8 is provided; this is to avoid electric breakdowns due to the potential differences (not shown) between the output wall 12 and the edge 25 for example formed at the junction of the surface of revolution 10 and the intermediate surface 14 which form the input wall 8.

Thus, in the case for example of an accelerating structure 1 intended to operate with metric waves, for which as was explained in the preamble focusing of the beam is particularly advantageous, an accelerating cavity CA in accordance with the invention has the following dimensions; given solely by way of non limiting example:

the angle $\alpha$ has a value of 70°;

the height H is 85 mm;

the distance D between the intersection edge 25 and the output wall 12 is 450 mm;

a distance D1 between the peripheral surface 13 of the input wall 8 and the output wall 12 and representing the length of the first accelerating cavity CA is 650 mm;

the peak potential difference between the input wall 8 and the output wall 12 is of the order of 6 to 7 MV.

It should be noted that in this connection the generatrix 11 of the surface of revolution 10 could be extended, as is shown by the broken line 11*a;* wall 8 being thus totally sloping with respect to the longitudinal axis 3 and joining the peripheral wall 30 at a distance D' from the output wall 12; the height H of the surface of revolution 10, measured along the longitudinal axis 3, being in all cases less than a distance D2 formed by the path of the charged particles in the accelerating cavity CA along the longitudinal axis 3. This configuration is possible in the case where the potential difference between the input wall 8 and the output wall 12 is small to avoid breakdown, as is often the case in a pre-grouping cavity; this latter function may be advantageously fulfilled by the cavity CA of the invention because of the effect of focusing the charged particles which it produces.

Figure 2:
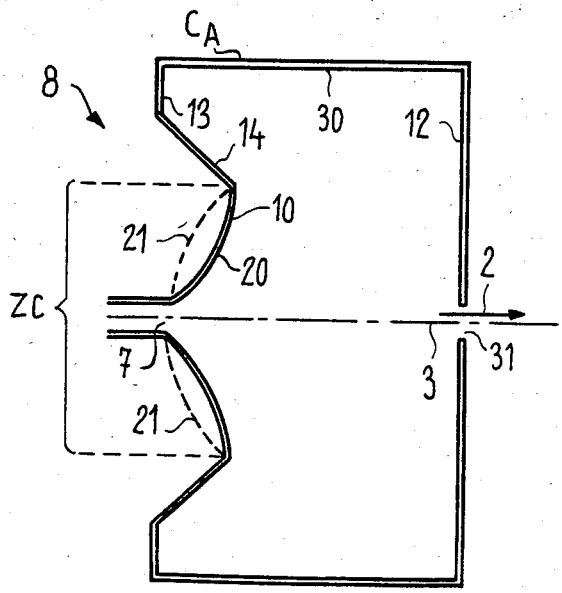
FIG. 2 shows a variant of accelerating self-focusing cavity in accordance with the invention.

The surface of revolution 10 of the accelerating cavity CA of the invention may also comprise, as is shown in FIG. 2, a first or second curved generatrix 20, 21 conferring on the surface of revolution 10 either a convex shape with the first curved generatrix 20 or a concave shape with the second curved generatrix 21.

This non limiting description shows that an accelerating cavity in accordance with the invention allows the charged particles of a beam accelerated in a linear accelerating structure to be focused because of the form given to its output wall 8; such a cavity CA provides a simple solution applicable to all types of linear accelerators.

What is claimed is:

1. In an accelerating self-focusing cavity for charged particles, intended to form the first or only cavity of a linear accelerating structure, comprising a longitudinal axis about which it is defined by a peripheral wall parallel to said longitudinal axis and joining an input wall to an output wall which define said accelerating cavity along said longitudinal axis, said longitudinal axis merging with the axis of a charged particle beam accelerated under the effect of an electromagnetic wave and penetrating into said accelerating cavity through an input orifice formed in said input wall, said output wall being substantially perpendicular to said longitudinal axis and comprising an output orifice through which said beam leaves said accelerating cavity, at least one central zone of said input wall is sloping with respect to said longitudinal axis and moves away therefrom in the direction of propagation of said beam so as to form a surface of revolution admitting said longitudinal axis as axis of revolution and forming through this surface of revolution a lens for focusing the charged particles.

2. The accelerating cavity as claimed in claim 1, wherein the surface of revolution comprises a generatrix formed of a straight line forming an angle less than 90° with said longitudinal axis.

3. The accelerating cavity as claimed in claim 2, wherein said straight line forming the generatrix forms an angle of 70° with said longitudinal axis.

4. The accelerating cavity as claimed in claim 1, wherein said surface of revolution comprises a generatrix formed by a curve.

* * * * *